US008449064B2

(12) United States Patent
Ito

(10) Patent No.: US 8,449,064 B2
(45) Date of Patent: May 28, 2013

(54) LIQUID EJECTING APPARATUS, METHOD AND PROGRAM OF CONTROLLING FLUID EJECTING APPARATUS, AND TARGET

(75) Inventor: Keigo Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 304 days.

(21) Appl. No.: 13/023,480

(22) Filed: Feb. 8, 2011

(65) Prior Publication Data

US 2011/0193907 A1 Aug. 11, 2011

(30) Foreign Application Priority Data

Feb. 9, 2010 (JP) ..... 2010-026262

(51) Int. Cl.
*B41J 29/38* (2006.01)

(52) U.S. Cl.
USPC ..... 347/14

(58) Field of Classification Search
CPC ..... B41J 3/543; B41J 3/60
USPC ..... 347/5, 14, 104
See application file for complete search history.

(56) References Cited

U.S. PATENT DOCUMENTS 5,266,976 A * 11/1993 Ohigashi et al. ..... 347/116
7,325,898 B2 * 2/2008 Kawazoe et al. ..... 347/19
8,020,985 B2 * 9/2011 Yoshida ..... 347/104
8,141,976 B2 * 3/2012 Motoyama et al. ..... 347/19

FOREIGN PATENT DOCUMENTS

JP 11-254866 9/1999

* cited by examiner

*Primary Examiner* — An Do
(74) *Attorney, Agent, or Firm* — Kilpatrick Townsend & Stockton LLP

(57) ABSTRACT

Provided is a fluid ejecting apparatus ejecting a fluid in a set ejection area of a target, including: a transport unit transporting the target; a fluid ejection unit moving in a perpendicular direction perpendicular to a transport direction of the target and being capable of ejecting the fluid from a nozzle to the target; a mark detection unit moving in the perpendicular direction together with the fluid ejection unit and being capable of detecting a predetermined mark formed in the target; a before-ejecting distance acquisition unit acquiring a before-ejecting distance; and a control unit controlling the transport unit and the fluid ejection unit based on the acquired before-ejecting distance so that the target is transported by the transport unit and the fluid is ejected from the nozzle to the set ejection area while the fluid ejection unit moves in the perpendicular direction.

10 Claims, 6 Drawing Sheets

LIQUID EJECTING APPARATUS, METHOD AND PROGRAM OF CONTROLLING FLUID EJECTING APPARATUS, AND TARGET

This application claims priority to Japanese Patent Application No. 2010-026262, filed Feb. 9, 2010, the entirety of which is incorporated by reference herein.

BACKGROUND

1. Technical Field

The present invention relates a fluid ejecting apparatus, a method and program of controlling a fluid ejecting apparatus, and a target.

2. Related Art

In the related art, there is disclosed a fluid ejecting apparatus where, if a print reference mark of a roll paper, in which a punched-shape portion and a substantially quadrangular print starting reference mark disposed in a paper-surface direction with respect to the punched-shape portion as a reference for the print starting position for performing printing in the punched-shape portion are formed, is detected by a photosensor, the roll paper is allowed to be wound so as to return to the print starting position from this time, and after that, while the roll paper is transported in a predetermined direction, printing is performed (refer to, for example, JP-A-11-254866).

In the case where the print reference mark has a shape of a quadrangle or the like as described above, in order to acquire a distance to the print starting position used to determine a roll paper winding amount, it is necessary to detect an end portion of the print reference mark in a predetermined direction or the opposite direction thereof.

SUMMARY

An advantage of some aspects of the invention is to provide a fluid ejecting apparatus, a method and program of controlling a fluid ejecting apparatus, and a target capable of more easily acquiring a distance from a detection position of a predetermined mark of the target in a transport direction to a set ejection area of the target.

The fluid ejecting apparatus, the method and program of controlling a fluid ejecting apparatus, and the target have the following configurations in order to achieve the aforementioned advantage.

According to an aspect of the invention, there is provided a fluid ejecting apparatus ejecting a fluid in a set ejection area of a target, including: a transport unit transporting the target; a fluid ejection unit moving in a perpendicular direction perpendicular to a transport direction of the target and being capable of ejecting the fluid from a nozzle to the target; a mark detection unit moving in the perpendicular direction together with the fluid ejection unit and being capable of detecting a predetermined mark formed in the target; a before-ejecting distance acquisition unit acquiring a before-ejecting distance, which is a distance from a detection position of the predetermined mark in the transport direction to the set ejection area, based on a perpendicular-direction length of the predetermined mark when the predetermined mark having a shape where the perpendicular-direction length is increased or decreased in the transport direction is detected by the mark detection unit during the movement of the fluid ejection unit; and a control unit controlling the transport unit and the fluid ejection unit based on the acquired before-ejecting distance so that the target is transported by the transport unit and the fluid is ejected from the nozzle to the set ejection area while the fluid ejection unit moves in the perpendicular direction.

In the fluid ejecting apparatus according to the above aspect of the invention, when the predetermined mark having a shape where the perpendicular-direction length is increased or decreased in the transport direction is detected by the mark detection unit during the movement of the fluid ejection unit, the before-ejecting distance which is a distance from a detection position of the predetermined mark to the set ejection area is acquired based on the perpendicular-direction length of the predetermined mark at the detection position of the predetermined mark in the transport direction. In addition, the transport unit and the fluid ejection unit are controlled based on the acquired before-ejecting distance so that the target is transported by the transport unit and the fluid is ejected from the nozzle to the set ejection area while the fluid ejection unit moves in the perpendicular direction. Therefore, since the before-ejecting distance is acquired based on the perpendicular-direction length of the predetermined mark at the detection position of the predetermined mark in the transport direction, it is not necessary to detect the transport direction end portion of the predetermined mark, and it is possible to more easily acquire the before-ejecting distance. In addition, in the case where the fluid is sequentially ejected to the set ejection areas in the target where the predetermined mark and the set ejection area are alternately disposed in the transport direction, the next predetermined mark is detected during the movement of the fluid ejection unit for ejecting the fluid to the set ejection area, and the next before-ejecting distance may be acquired, so that it is possible to short the time taken to complete the ejection of the fluid to a plurality of the set ejection areas. Herein, the "predetermined mark" may be a triangle having a side in the perpendicular direction, a trapezoid having two sides in the perpendicular direction, or the like. In addition, the "predetermined mark" may be a hole. In addition, with respect to the predetermined mark, the "shape where the perpendicular-direction length is increased or decreased in the transport direction" denotes that the perpendicular-direction length at an arbitrary position in the transport direction and a distance from the arbitrary position to the transport direction end portion have a one-to-one correspondence.

In the fluid ejecting apparatus according to the above aspect of the invention, the predetermined mark detection unit may be disposed at the transport-direction upstream side of the nozzle of the fluid ejection unit. In this case, the target may be configured so that the predetermined marks and the set ejection areas are alternately disposed in the transport direction, and the control unit may control the fluid ejection unit so as for the fluid to be ejected from the nozzle to a current set ejection area and a next set ejection area in the case where, before the ejection of the fluid to the current set ejection area is finished, the next predetermined mark is detected by the mark detection unit, and after a next before-ejecting distance is acquired by the before-ejecting distance acquisition unit, the fluid is able to be ejected to the next set ejection area. Accordingly, it is possible to short the time taken to complete the ejection of the fluid to a plurality of the set ejection areas.

In addition, in the fluid ejecting apparatus according to the aspect the invention, the before-ejecting distance acquisition unit may acquire the before-ejecting distance by using transport-direction and perpendicular-direction lengths of the predetermined mark and a perpendicular-direction length of the predetermined mark at a detection position of the predetermined mark in the transport direction.

In addition, in the fluid ejecting apparatus according to the aspect the invention, the target may be configured so that the set ejection area is disposed in a predetermined interval in the transport direction; when the predetermined mark is detected by the mark detection unit, the before-ejecting distance acquisition unit may acquire a predetermined number of the before-ejecting distances from the predetermined mark to a predetermined number of two or more of the set ejection areas in the rear side in the transport direction; and the control unit may perform controlling based on the before-ejecting distance of a predetermined number.

According to another aspect of the invention, there is provided a method of controlling a fluid ejecting apparatus which includes a transport unit transporting a target, a fluid ejection unit moving in a perpendicular direction perpendicular to a transport direction of the target and being capable of ejecting the fluid from a nozzle to the target, and a mark detection unit moving in the perpendicular direction together with the fluid ejection unit and being capable of detecting a predetermined mark formed in the target to eject the fluid in a set ejection area of the target, the method including: (a) acquiring a before-ejecting distance, which is a distance from a detection position of the predetermined mark in the transport direction to the set ejection area, based on a perpendicular-direction length of the predetermined mark when the predetermined mark having a shape where the perpendicular-direction length is increased or decreased in the transport direction is detected by the mark detection unit during the movement of the fluid ejection unit; and (b) controlling the transport unit and the fluid ejection unit based on the acquired before-ejecting distance so that the target is transported by the transport unit and the fluid is ejected from the nozzle to the set ejection area while the fluid ejection unit moves in the perpendicular direction.

In the method of controlling the fluid ejecting apparatus according to the above aspect of the invention, when the predetermined mark having a shape where the perpendicular-direction length is increased or decreased in the transport direction is detected by the mark detection unit during the movement of the fluid ejection unit, the before-ejecting distance which is a distance from a detection position of the predetermined mark to the set ejection area is acquired based on the perpendicular-direction length of the predetermined mark at the detection position of the predetermined mark in the transport direction. In addition, the transport unit and the fluid ejection unit are controlled based on the acquired before-ejecting distance so that the target is transported by the transport unit and the fluid is ejected from the nozzle to the set ejection area while the fluid ejection unit moves in the perpendicular direction. Therefore, since the before-ejecting distance is acquired based on the perpendicular-direction length of the predetermined mark at the detection position of the predetermined mark in the transport direction, it is not necessary to detect the transport direction end portion of the predetermined mark, and it is possible to more easily acquire the before-ejecting distance. In addition, in the case where the fluid is sequentially ejected to the set ejection areas in the target where the predetermined mark and the set ejection area are alternately disposed in the transport direction, the next predetermined mark is detected during the movement of the fluid ejection unit for ejecting the fluid to the set ejection area, and the next before-ejecting distance may be acquired, so that it is possible to short the time taken to complete the ejection of the fluid to a plurality of the set ejection areas.

According to still another aspect of the invention, there is provided a program for embodying the steps of the aforementioned method of controlling a fluid ejecting apparatus on one computer or a plurality of computers. The program may be recorded in a computer readable recording medium (for example, a hard disk, a ROM, an FD, a CD, a DVD, or the like) or transmitted through a transmission medium (communication network such as the Internet or a LAN) from one computer to another computer. In addition, the program may be transmitted and received in any other forms. If the program is executed in one computer if the processes of the program are executed in a plurality of computers in a distributive manner, the steps of the aforementioned method of controlling the fluid ejecting apparatus are performed, so that it is possible to obtain the same functions and effects as those of the method of controlling the fluid ejecting apparatus.

According to further still another aspect of the invention, there is provided a target used for a fluid ejecting apparatus including a transport unit transporting the target, a fluid ejection unit moving in a perpendicular direction perpendicular to a transport direction of the target and being capable of ejecting the fluid from a nozzle to the target, a mark detection unit moving in the perpendicular direction together with the fluid ejection unit and being capable of detecting a predetermined mark formed in the target, a before-ejecting distance acquisition unit acquiring a before-ejecting distance, which is a distance from a detection position of the predetermined mark in the transport direction to the set ejection area, based on a perpendicular-direction length of the predetermined mark when the predetermined mark is detected by the mark detection unit during the movement of the fluid ejection unit; and a control unit controlling the transport unit and the fluid ejection unit based on the acquired before-ejecting distance so that the target is transported by the transport unit and the fluid is ejected from the nozzle to the set ejection area while the fluid ejection unit moves in the perpendicular direction, wherein the predetermined mark has a shape where the perpendicular-direction length is increased or decreased in the transport direction.

The target according to the above aspect of the invention is used for the aforementioned fluid ejecting apparatus according to the aspect the invention, and the predetermined mark is formed to have a shape where the perpendicular-direction length is increased or decreased in the transport direction. Therefore, it is possible to more easily acquire the before-ejecting distance.

In the target according to the above aspect of the invention, the predetermined mark may be any one of a triangle having a side in the perpendicular direction and a trapezoid having two sides in the perpendicular direction. In addition, the predetermined mark may be a hole.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
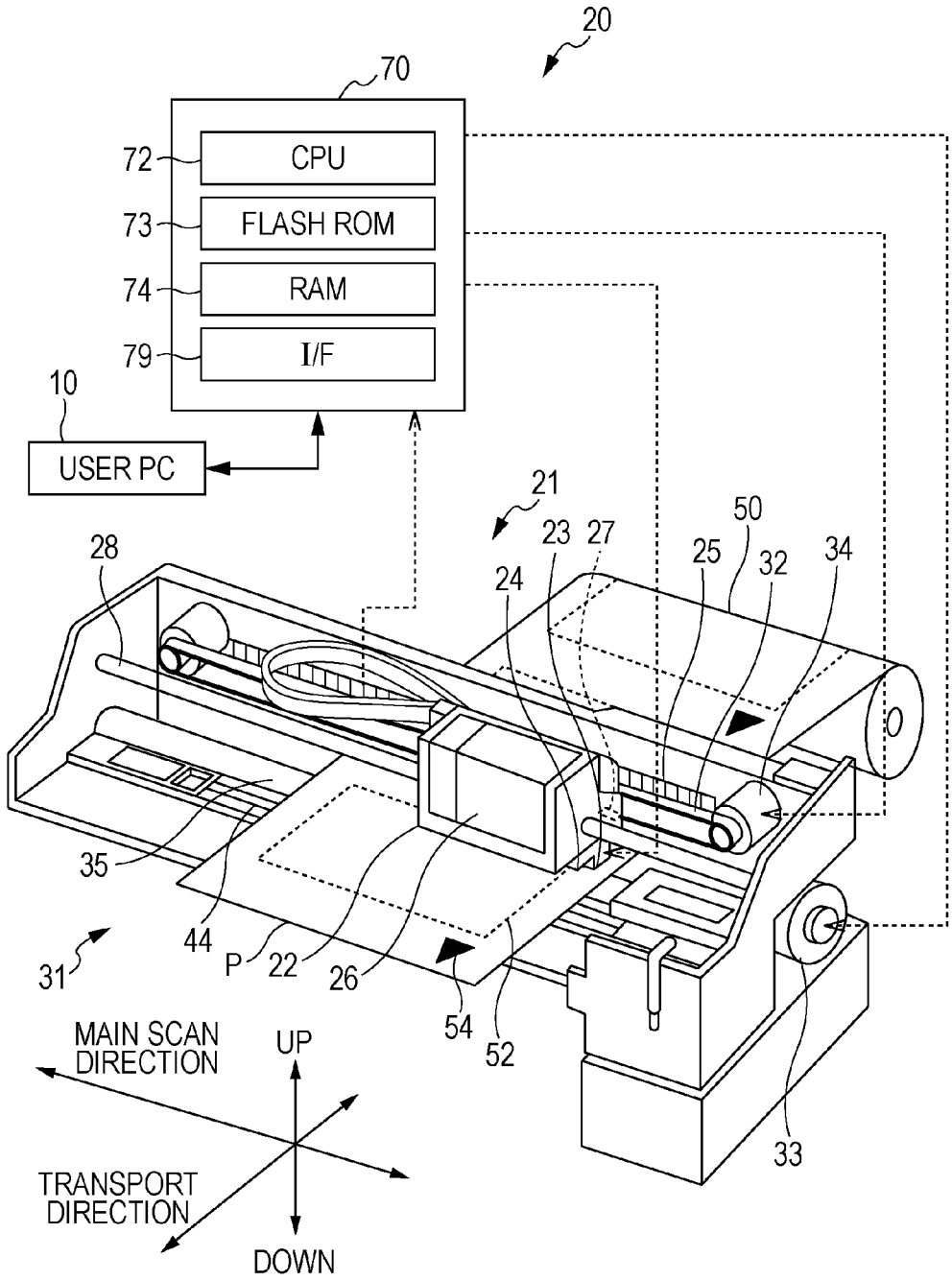
FIG. 1 is a brief diagram illustrating a configuration of a printer.

Next, embodiments of the invention are described with reference to the drawings. FIG. 1 is a brief diagram illustrating a configuration of a printer 20 according to an embodiment of the invention. As illustrated in FIG. 1, a printer 20 according to the embodiment includes a printer mechanism 21 which is constructed with a print head 24, a carriage 22, and the like, a sheet transporting mechanism 31 which includes a sheet transporting roller 35 driven by a driving motor 33 to transport a recording paper P drawn out from a roll 50 in the forward direction (hereinafter, referred to as a transport direction) from the deep side in the figure, and a controller 70 which controls the entire printer 20.

The printer mechanism 21 includes the carriage 22 which is reciprocatingly moved along a guide 28 by a carriage belt 32 and a carriage motor 34 in the leftward/rightward direction (a perpendicular direction perpendicular to the transport direction, hereinafter referred to a perpendicular direction or a main scan direction) in the figure, ink cartridges 26, each of which is mounted on the carriage 22 to individually contain ink of each color of yellow (Y), magenta (M), cyan (C), and black (K), the print head 24 which ejects ink droplets as fluid from nozzles 23 by applying pressure to each ink supplied from each of the ink cartridges 26, and a platen 44 which is a supporting member of supporting the recording paper P during the printing. A linear type encoder 25 of detecting a position of the carriage 22 is disposed in the vicinity of the carriage 22. By using the linear type encoder 25, the position of the carriage 22 can be managed. The print head 24 is installed in the lower portion of the carriage 22. A voltage is applied to a piezoelectric element, so that the piezoelectric element is deformed so as to apply pressure to ink. By using the pressing method, the ink of each color is ejected from the nozzle 23 installed in the bottom surface of the print head 24. In addition, as a mechanism of applying pressure to the ink, a mechanism of generating bubbles through heat from a heater may be employed. A photosensor 27 which emits light toward the recording paper P and, after that, receives reflected light to detect a coordinate (hereinafter, referred to as a boundary coordinate) of a boundary between a hole 54 opened in the recording paper P and the recording paper P is disposed in a side (a transport-direction upstream side) deeper in the figure than the nozzles 23 in the bottom surface side of the print head 24. Since the photosensor 27 together with the carriage 22 is moved in the main scan direction, the photosensor 27 may detect the boundary coordinate of the hole 54 in the main scan direction (paper surface direction) during the movement of the carriage 22. Although not shown, the ink cartridge 26 is configured as a container of containing each ink used for printing cyan (C), magenta (M), yellow (Y), black (K), and the like, which contains pigment or dye as a colorant in water as a solvent. The ink cartridge 26 is detachably mounted on the carriage 22.

As illustrated in FIG. 1, the controller 70 is configured to include a microprocessor in which a CPU 72 plays a central role, a flash ROM 73 which stores various process programs and is allowed to rewrite data therein, a RAM 74 which temporarily stores data or retains data, an interface (I/F) 79 which performs information exchange with external apparatuses such as a user PC 10, and input and output ports (not shown). A position signal from the linear type encoder 25, the boundary coordinate of the hole 54 from the photosensor 27, or the like is input through the input port to the controller 70. A driving signal to the carriage motor 34, a driving signal to the print head 24, a driving signal to the driving motor 33, or the like is output through the output port from the controller 70.

Figure 2:
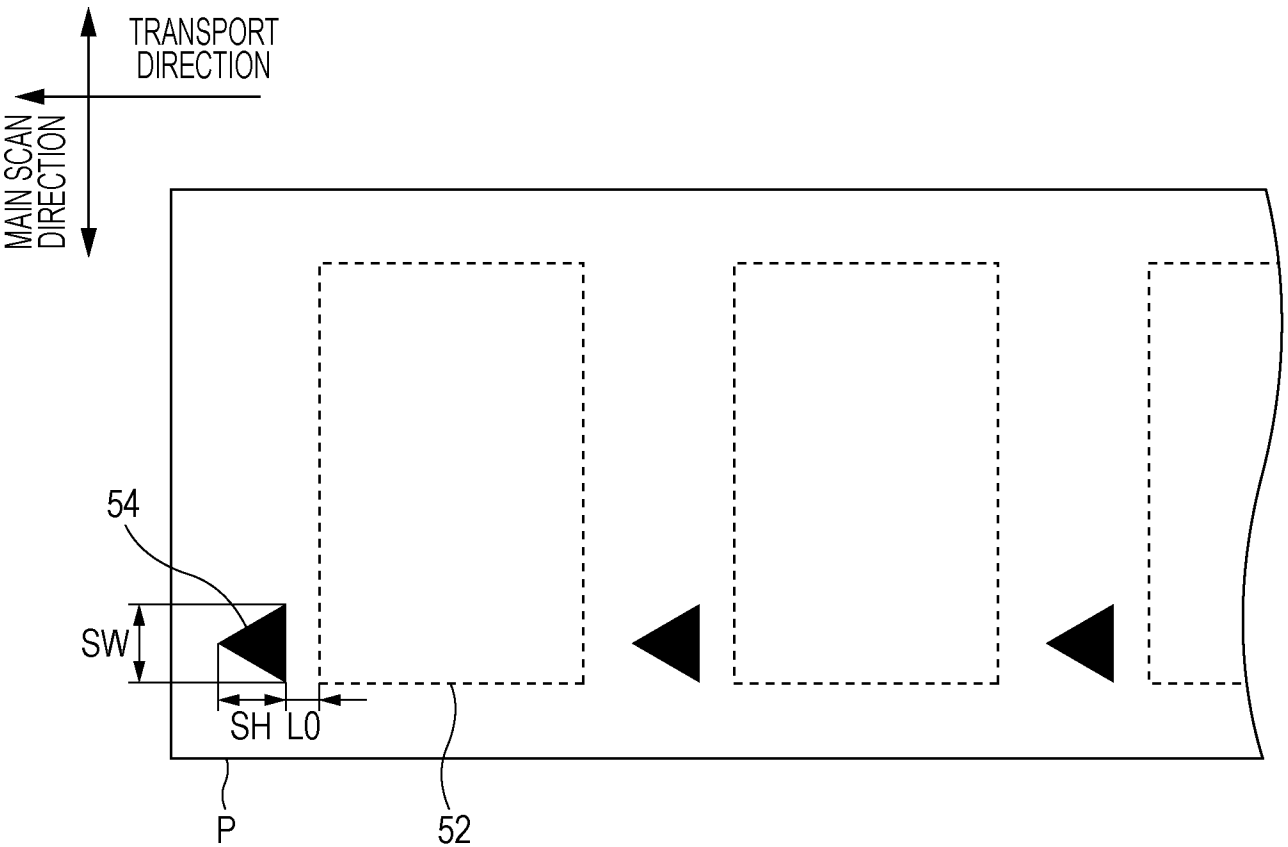
FIG. 2 is a diagram illustrating an example of a recording paper.

As illustrated in FIG. 2, in the recording paper P used by the printer 20 having the aforementioned configuration, set printing areas 52 for printing an image are disposed in a predetermined interval in the transport direction. The hole 54 used for position alignment for performing printing in each of the set printing areas 52 is opened at a position separated by a predetermined distance L0 from each of the set printing areas 52 in the front side in the transport direction. Herein, in the embodiment, the recording paper P is a sealing paper in which a seal (a paper, a film, or the like) is peelably adhered on a pasteboard, and the set printing area 52 is an area in a rectangular cut portion which is inserted in only the seal of the sealing paper. In addition, the hole 54 is formed in a shape where the width (paper-surface-direction length) thereof is increased or decreased in the transport direction (a width at an arbitrary position in the transport direction and a distance from the arbitrary position to the transport direction end portion or a before-printing distance described later have a one-to-one correspondence). In the embodiment, the hole 54 is formed in a shape of a triangle having a side in the paper-surface direction (in the example of FIG. 2, a triangle (for example, an equilateral triangle, an isosceles triangle, or the like) having a width SW and a height (transport direction length) SH).

Figure 3:
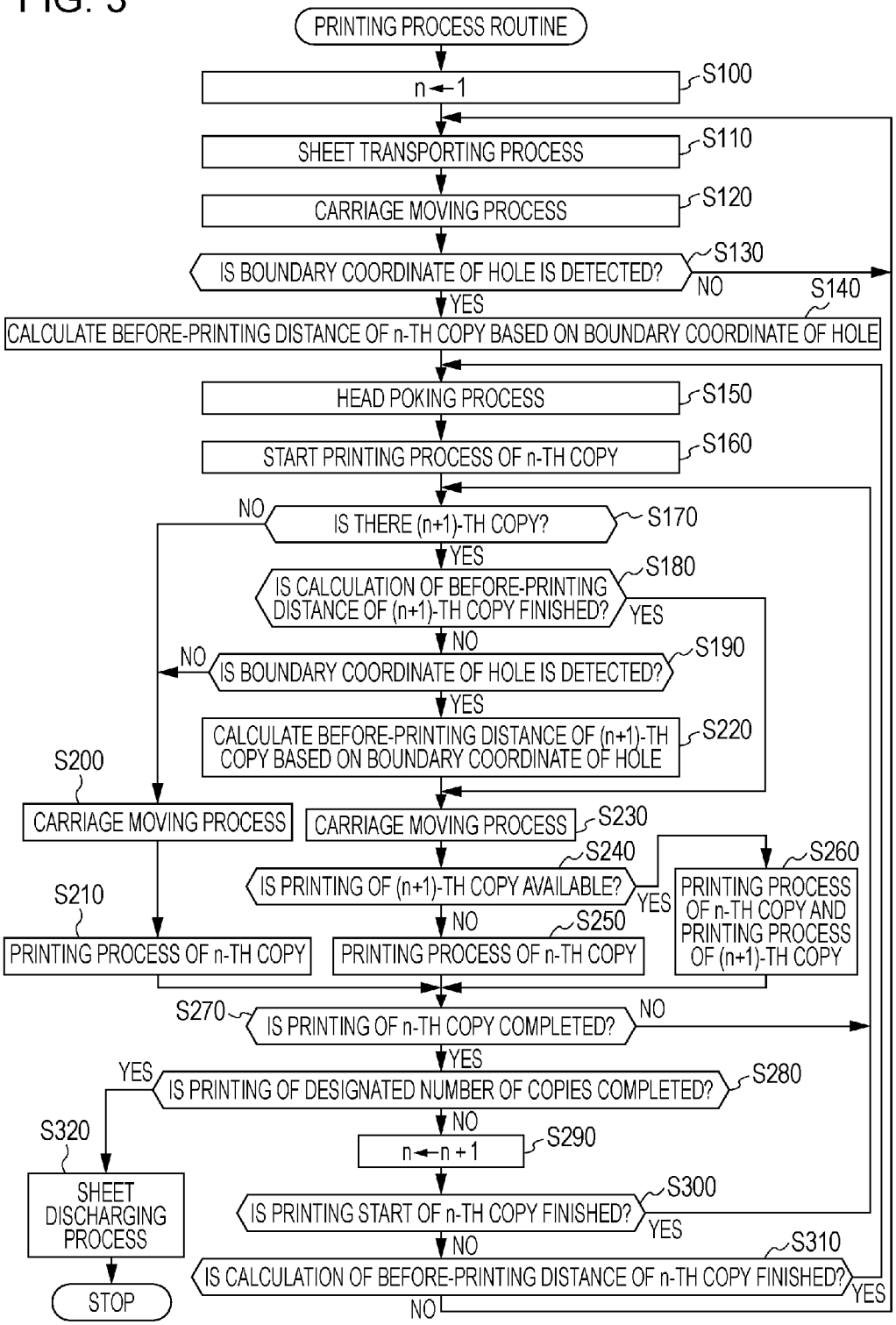
FIG. 3 is a flowchart illustrating an example of a printing process routine.

Next, operations of the printer 20 having the aforementioned configuration according to the embodiment, particularly, operations at the time of performing printing in a plurality of the set printing areas 52 while transporting the recording paper P drawn out from the roll 50 will be described. FIG. 3 is a flowchart illustrating an example of a printing process routine performed by the CPU 72. The routine is executed when a printing job (printing data, a designated number of copies, or the like) is received from the user PC 10 and printing is performed on the recording paper P.

Figure 4:
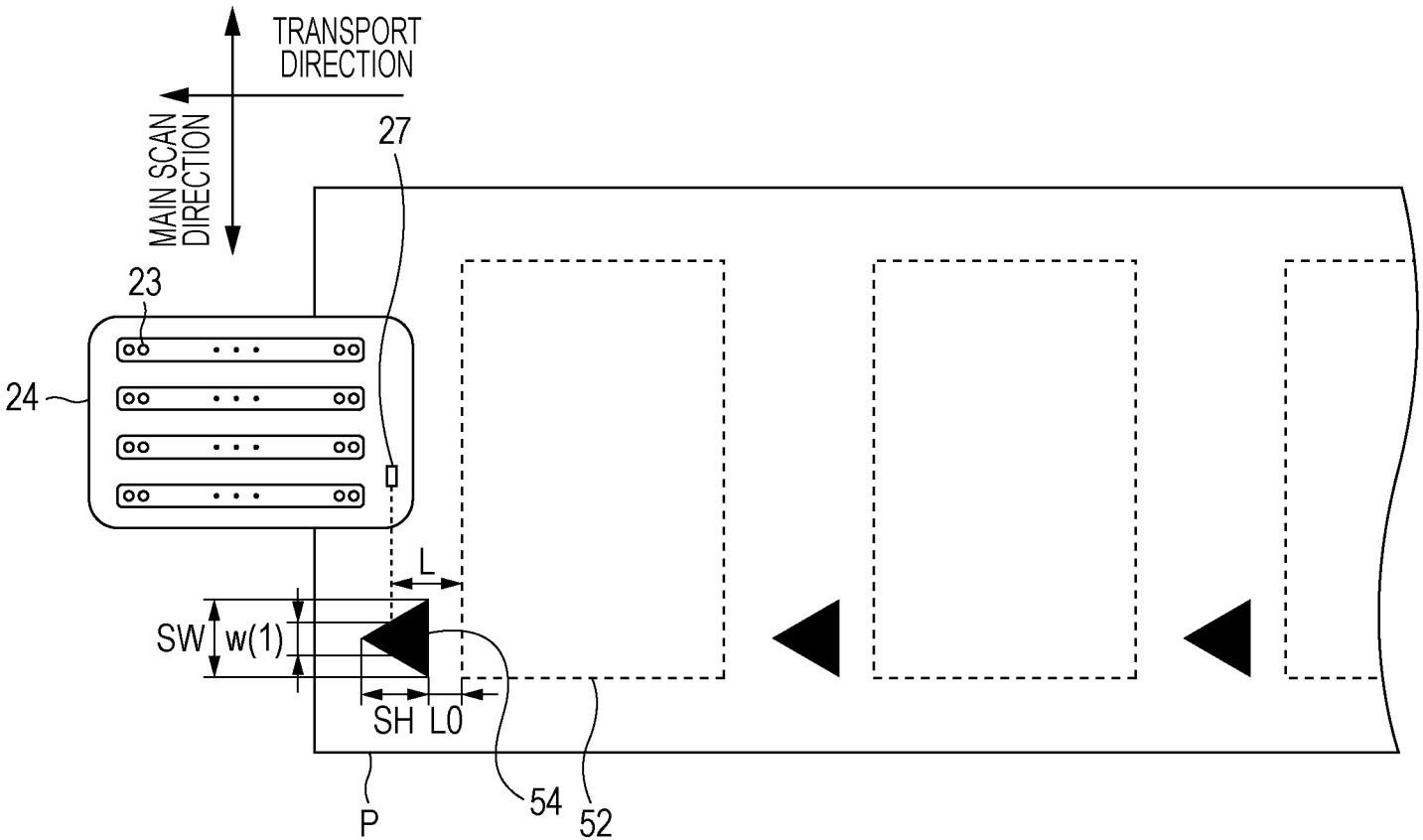
FIG. 4 is a diagram illustrating a behavior when a boundary coordinate of a hole is detected.

If the printing process routine is executed, first, the CPU 72 sets a number n indicating how many copies are to be printed to 1 (Step S100). Next, a sheet transporting process (Step S110) of controlling the driving of the driving motor 33 so as for the recording paper P to be transported by only a predetermined amount by the sheet transporting roller 35 and a carriage moving process (Step S120) of controlling the driving of the carriage motor 34 so as for the carriage 22 to be moved in the main scan direction are repetitively performed until the boundary coordinate of the hole 54 formed in the front side from an set printing area of an n-th copy is detected by the photosensor 27 during the movement of the carriage 22 (Steps S110 to S130). If the boundary coordinate of the hole 54 is detected (Step S130), a distance (hereinafter, referred to as a before-printing distance L(n)) to the set printing area of the n-th copy is calculated based on the width w(n) of the hole 54 obtained from the detected boundary coordinate (Step S140). Herein, the before-printing distance L(n) may be calculated by the following Equation (1) by using the width w(n) of the hole 54, the height SH and the width SW of the hole 54, and the distance L0 between the hole 54 and the set printing area. For a reference, a behavior of the case where the boundary coordinate of the hole 54 is detected illustrated in FIG. 4. In this manner, since the before-printing distance L(n) with respect to the n-th copy may be calculated by using the width w(n) of the hole 54 obtained from the detected boundary coordinate of the hole 54, it is not necessary to detect the transport direction end portion of the hole 54, and it is possible to more easily calculate the before-printing distance L(n).

$$L(n)=SH\cdot(1-w(n)/SW)+L0 \quad (1)$$

If the before-printing distance L(n) is calculated in this manner, a head poking process of controlling driving the driving motor 33 is performed so that the recording paper P is transported by the sheet transporting roller 35 by only a transporting amount(hereinafter, referred to as a before-printing transporting amount) obtained by considering the calculated before-printing distance L(n), a positional relationship between the nozzle 23 and the photosensor 27, or the like (Step S150). The printing of the n-th copy is started by performing a printing process of controlling driving the carriage motor 34 or the print head 24 so that ink droplets are ejected from the nozzle 23 according to the movement of the carriage 22 based on the received printing data (Step S160).

Subsequently, it is determined whether or not the printing of the (n+1)-th copy exists (whether or not the printing of the n-th copy is the printing of a designated number of copies) (Step S170). In the case where it is determined that the printing of the (n+1)-th copy exists, it is determined whether or not the calculation of the before-printing distance L(n+1) with respect to the (n+1)-th copy is completed by the later-described Step S220 (Step S180). In the case where it is determined that the before-printing distance L(n+1) with respect to the (n+1)-th copy is not yet calculated, it is determined whether or not the boundary coordinate of the hole 54 interposed between the set printing area of the n-th copy and the set printing area of the (n+1)-th copy is detected by the photosensor 27 during the movement of the carriage 22 for printing (Step S190).

In Steps S170 to S190, in the case where it is determined that the printing of the (n+1)-th copy does not exist or in the case where it is determined that the printing of the (n+1)-th copy exists but the before-printing distance L(n+1) with respect to the (n+1)-th copy is not yet calculated and the boundary coordinate of the hole 54 is not yet detected, the sheet transporting process is performed (Step S200). Next, the printing process with respect to the n-th copy is performed based on the printing data (Step S210), and it is determined whether or not the printing of the n-th copy is completed (Step S270). In the case where the printing of the n-th copy is not yet completed, the procedure returns to Step S170.

Figure 5:
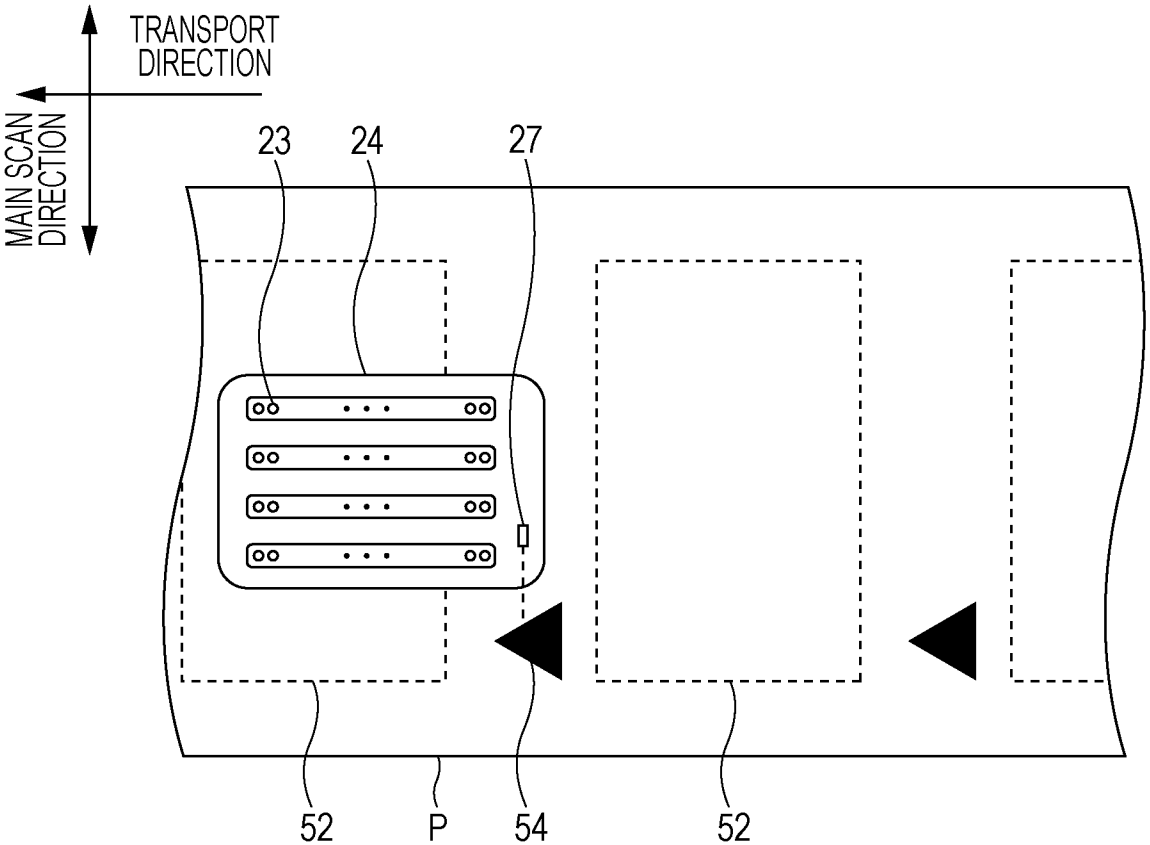
FIG. 5 is a diagram illustrating an example of a positional relationship in the transport direction between a recording paper and a print head.

In Steps S170 to S190, in the case where the printing of the (n+1)-th copy exists and the before-printing distance L(n+1) with respect to the (n+1)-th copy is not yet calculated but the boundary coordinate of the hole 54 is detected, similarly to the process of the aforementioned Step S140, the before-printing distance L(n+1) with respect to the (n+1)-th copy is calculated based on the width w(n+1) of the hole 54 obtained from the boundary coordinate of the hole 54 (Step S220). FIG. 5 illustrates an example of a positional relationship in the transport direction between the recording paper P and the print head 24 when the boundary coordinate of the hole 54 is detected. In this manner, since the next before-printing distance L(n+1) may be calculated by using the detected width w(n+1) of the hole 54, it is possible to more easily calculate the next before-printing distance L(n+1). In addition, since the width w(n+1) of the next hole 54 is detected during the movement of the carriage 22 for the printing of the n-th copy and the next before-printing distance L(n+1) may be calculated, it is possible to further shorten the time taken to complete the printing of a plurality of copies in comparison with the case where the next before-printing distance L(n+1) is not calculated only after the printing of the n-th copy is completed.

Figure 6:
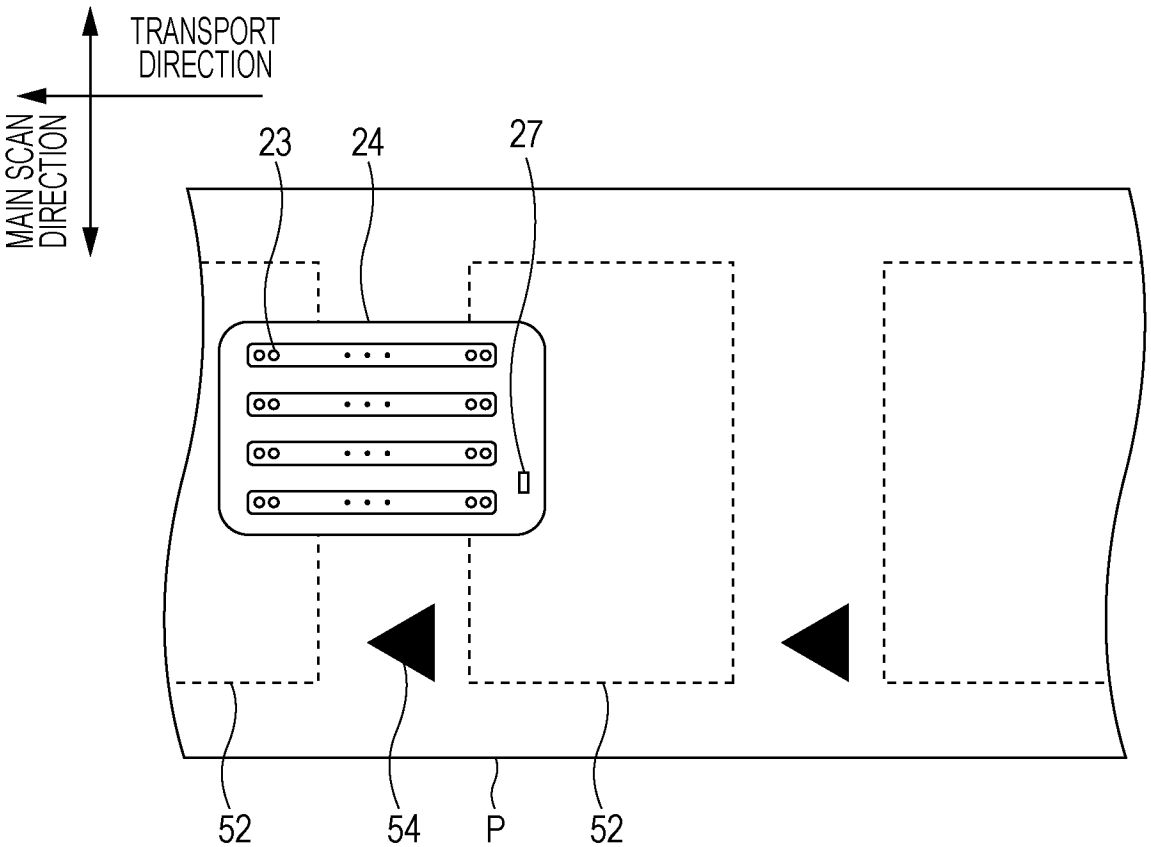
FIG. 6 is a diagram illustrating an example of a positional relationship in the transport direction between a recording paper and a print head.

Subsequently, the sheet transporting process is performed (Step S230), it is determined by taking into consideration the before-printing distance L(n+1) whether or not ink droplets may be ejected from the nozzles 23 of the print head 24 to the set printing area of the (n+1)-th copy (whether or not a portion of the nozzles 23 of the print head 24 passes through the upper side of the set printing area of the (n+1)-th copy during the movement of the carriage 22) (Step S240). In the case where it is determined that the ink droplets may not be ejected in the set printing area of the (n+1)-th copy from the nozzles 23, the printing process for the n-th copy is performed based on the printing data (Step S250). In the case where it is determined that the ink droplets may be ejected in the set printing area of the (n+1)-th copy from the nozzles 23, the printing process for the n-th copy and the (n+1)-th copy is performed based on the printing data (Step S260). It is determined whether or not the printing for the n-th copy is completed (Step S270). In the case where it is determined that the printing for the n-th copy is not completed, the procedure returns to Step S170. FIG. 6 illustrates an example of a positional relationship in the transport direction between the recording paper P and the print head 24 in the case where the ink droplets may be ejected in the set printing area of the (n+1)-th copy from the nozzles 23. In this manner, in the case where the ink droplets may be ejected in the set printing area of the (n+1)-th copy from the nozzles 23, the n-th copy and the (n+1) copy are simultaneously printed, so that it is possible to further shorten the time taken to compete the printing of a plurality of copies.

In Steps S170 and S180, in the case where it is determined that the printing of the (n+1)-th copy exits and the calculation of the before-printing distance L(n+1) with respect to the (n+1)-th copy is completed, the sheet transporting process and the printing process for the n-th copy or the printing process for the n-th copy and the (n+1)-th copy are performed (Steps S230 to S260). It is determined whether or not the printing for the n-th copy is completed (Step S270). In the case where it is determined that the printing for the n-th copy is not completed, the procedure returns to Step S170.

In this manner, if the printing for the n-th copy is completed by repetitively performing the processes of Steps S170 to S270 (Step S270), it is determined whether or not the printing for the designated number of copies is completed (Step S280). In the case where it is determined that the printing for the designated number of copies is not yet completed, the number n is incremented (Step S290). It is determined whether or not the printing for the n-th copy after the increment is already started (Step S300). In the case where it is determined that the printing for the n-th copy after the increment is already started, the procedure returns to Step S170, and the printing in the next set printing area is performed (Steps S170 to S270). On the other hand, in the case where it is determined that the printing for the n-th copy after the increment is not yet started, it is determined whether or not the calculation of the before-printing distance L(n) with respect to the n-th copy after the increment is already completed (Step S310). In the case where it is determined that the calculation of the before-printing distance L(n) with respect to the n-th copy after the increment is completed, the procedure returns to Step S150, and a head poking process for the next set printing area is performed, so that the printing thereof is performed (Steps S150 to S270). In the before-printing distance L(n) with respect to the n-th copy after the increment is not yet calculated, the boundary coordinate of the hole 54 is detected by the sheet transporting process and the carriage moving process, and the before-printing distance L(n) with respect to the n-th copy is calculated (Steps S110 to S140). The head poking process is performed based on the before-printing distance L(n), so that the printing is performed (Steps S150 to S270). In this manner, if the printing for the designated number of copies is completed (Step S280), a discharging process of controlling the driving of the driving motor 33 is performed so as for the recording paper P to be transported for paper discharge by the sheet transporting roller 35 (Step S320), and the routine is ended.

Herein, the correspondence relationship between the components of the embodiment and the components of the invention is clarified. The sheet transporting mechanism 31 including the sheet transporting roller 35 or the driving motor 33 of the embodiment corresponds to the "transport unit" of the invention. The component including the carriage 22 or the carriage motor 34, the nozzle 23, and the print head 24 corresponds to the "fluid ejection unit". The photosensor 27 corresponds to the "mark detection unit". The controller 70 performing the processes of Steps 140 and S220 in the printing process routine of FIG. 3 corresponds to the "before-ejecting distance acquisition unit". The controller 70 performing the processes of Steps S150, S160, S200, S210, and S230 to S270 in the printing process routine of FIG. 3 corresponds to the "control unit".

In the printer 20 according to the embodiment described above, when the boundary coordinate of the hole 54 in the main scan direction is detected by the photosensor 27 during the movement of the carriage 22, the before-printing distance as a distance to the set printing area is calculated based on the width of the hole 54 obtained from the detected boundary coordinate of the hole 54. The recording paper P is transported based on the calculated before-printing distance by the sheet transporting mechanism 31, and the driving of the driving motor 33, the carriage motor 34, or the print head 24 is controlled so that the ink droplets are ejected from the nozzles 23 according to the movement of the carriage 22 based on the received printing data. Therefore, it is not necessary to detect the transport direction end portion of the hole 54, and it is possible to more easily calculate the before-printing distance. In addition, since the width w(n+1) of the next hole 54 is detected during the movement of the carriage 22 for the printing of the n-th copy and the next before-printing distance L(n+1) may be calculated, it is possible to further shorten the time taken to complete the printing of a plurality of copies.

In addition, the invention is not limited to the aforementioned embodiment, and various embodiments may be implemented within the scope of the invention.

In the aforementioned embodiment, as illustrated in FIG. 2, in the recording paper P, the hole 54 is formed to have a shape of a triangle having a side in the paper-surface direction and a vertex in the front side of the recording paper P with respect to the side. However, the hole 54 may be formed to have a shape of a triangle having a side in the paper-surface direction and a vertex in the rear side (the roll 50 side) of the recording paper P with respect to the side. In addition, the shape of the hole 54 is not limited to the triangle, but any shape where the width (paper-surface-direction length) thereof is increased or decreased in the transport direction may be employed. For example, a trapezoid or the like having two sides in the paper-surface direction may be employed.

In the aforementioned embodiment, the boundary coordinate of the hole 54 in the main scan direction(paper-surface direction) is detected, and the before-printing distance is calculated by using the width of the hole 54 obtained from the detected boundary coordinate of the hole 54. However, the boundary coordinate of the hole 54 is not detected, but the width of the hole 54 is detected and the before-printing distance may be calculated by using the detected width of the hole 54.

In the aforementioned embodiment, the before-printing distance L(n) is calculated by Equation (1) by using the width w(n) of the hole 54 obtained from the detected boundary coordinate of the hole 54. However, the width w(n) of the hole 54 is not detected, but the before-printing distance L(n) may be set by applying a table which is defined as a relationship between the width of the hole 54 and the distance L(n) in advance.

In the aforementioned embodiment, for example, when the boundary coordinate of the next hole 54 with respect to the set printing area of the n-th copy is detected, the before-printing distance L(n+1) with respect to the (n+1)-th copy is calculated. However, in the case where the set printing areas are disposed in a predetermined interval in the transport direction, the before-printing distances L(n+1) to L(n+k) with respect to the copies from the (n+1)-th copy to the (n+k)-th copy (k is an integer of 2 or more) as well as the before-printing distance L(n+1) with respect to the (n+1)-th copy may be collectively calculated. In addition, in this case, the boundary coordinate of the next hole 54 in each of k set printing areas may be detected by the photosensor 27.

In the aforementioned embodiment, when the boundary coordinate of the next hole 54 is detected during the movement of the carriage 22, the next before-printing distance is calculated. However, a standard value of the before-printing distance is calculated initially once or every time when a predetermined number of the boundary coordinates of the holes 54 are detected, and in the other cases, when the boundary coordinate of the hole 54 is detected, an error between a predicted value of the sheet transporting amount predicted from the width of the hole 54 obtained from the boundary coordinate of the hole 54 and the real sheet transporting amount is calculated. The before-printing distance for each of the set printing areas may be corrected by using the calculated error.

In the aforementioned embodiment, in the recording paper P, one hole 54 and one set printing area are alternately disposed in the transport direction. However, one hole 54 and a predetermined number (two or more) of the set printing areas may be alternately disposed.

In the aforementioned embodiment, the hole 54 is opened in the recording paper P. However, the invention is not limited to the hole 54, but a mark having a color different from that of the recording paper P, a mark having any shape where the perpendicular-direction length is increased or decreased in the transport direction, or the like may be formed at a predetermined position with respect to the set printing area.

In the aforementioned embodiment, the recording paper P is a sealing paper in which a seal (a paper, a film, or the like) is peelably adhered on a pasteboard. However, the invention is not limited to the sealing paper, but any paper such as a normal paper or a matt paper may be used. In addition, In the aforementioned embodiment, the set printing area 52 is an area in a rectangular cut portion which is inserted in only the seal of the sealing paper. However, the invention is not limited to the rectangle, but any shape such as a circle or a triangle may be employed. A shape where a frame and the like instead of the cut portion is formed may be employed.

In the aforementioned embodiment, the example where the fluid ejecting apparatus according to the invention is embodied in the printer 20 is described. However, the invention may be embodied in a fluid ejecting apparatus which ejects a liquid phase material (dispersed liquid) where liquid other than ink or particles of a functional material are dispersed, a fluid phase material, such as a gel, or the like. In addition, the invention may also be embodied in a fluid ejecting apparatus which ejects solids which may be ejected as a fluid. For example, the invention may be embodied in a liquid ejecting apparatus which ejects a liquid in which an electrode material, a coloring material, or the like used to manufacture a liquid crystal display, an EL (electroluminescence) display, a surface emission display, or the like is dissolved, a liquid ejecting apparatus which ejects a liquid phase material in which the same material is dispersed, and a liquid ejecting apparatus which ejects a liquid which becomes a specimen used as a precision pipette. In addition, the invention may be embodied in a liquid ejecting apparatus which ejects a lubricant in a precision machine such as a watch or a camera by using a pin point, a liquid ejecting apparatus which ejects a transparent resin solution such as a UV cured resin on a substrate so as to form a hemispherical microlens (optical lens) or the like used for an optical communication device, a liquid ejecting apparatus which ejects an acid or alkali etchant so as to etch a substrate or the like, a liquid phase material ejecting apparatus which ejects a gel, and a powder ejecting apparatus which ejects powder such as toner.

In the aforementioned embodiment, the invention is described as the printer 20 having a printing function. However, the invention may be adapted to a multi-functional printer having a scanner function as well as the printing function. In addition, the invention may be adapted to a facsimile or the like having a printing function.

In the aforementioned embodiment, the fluid ejecting apparatus according to the invention is described by using an example implemented in the printer 20. However, the invention may be implemented as an aspect of a method of controlling the fluid ejecting apparatus. In addition, the invention may be implemented as an aspect of a program for implementing the steps of the fluid ejecting apparatus on one computer or a plurality of computers. In addition, the invention may be implemented as an aspect of a target used for the fluid ejecting apparatus.

What is claimed is:

1. A fluid ejecting apparatus ejecting a fluid in a set ejection area of a target, comprising:

a transport unit transporting the target;

a fluid ejection unit moving in a perpendicular direction perpendicular to a transport direction of the target and being capable of ejecting the fluid from a nozzle to the target;

a mark detection unit moving in the perpendicular direction together with the fluid ejection unit and being capable of detecting a predetermined mark formed in the target;

a before-ejecting distance acquisition unit acquiring a before-ejecting distance, which is a distance from a detection position of the predetermined mark in the transport direction to the set ejection area, based on a perpendicular-direction length of the predetermined mark when the predetermined mark having a shape where the perpendicular-direction length is increased or decreased in the transport direction is detected by the mark detection unit during the movement of the fluid ejection unit; and a control unit controlling the transport unit and the fluid ejection unit based on the acquired before-ejecting distance so that the target is transported by the transport unit and the fluid is ejected from the nozzle to the set ejection area while the fluid ejection unit moves in the perpendicular direction.

2. The fluid ejecting apparatus according to claim 1, wherein the predetermined mark detection unit is disposed at the transport-direction upstream side of the nozzle of the fluid ejection unit.

3. The fluid ejecting apparatus according to claim 2, wherein the target is configured so that the predetermined marks and the set ejection areas are alternately disposed in the transport direction, and wherein the control unit controls the fluid ejection unit so as for the fluid to be ejected from the nozzle to a current set ejection area and a next set ejection area in the case where, before the ejection of the fluid to the current set ejection area is finished, the next predetermined mark is detected by the mark detection unit, and after a next before-ejecting distance is acquired by the before-ejecting distance acquisition unit, the fluid is able to be ejected to the next set ejection area.

4. The fluid ejecting apparatus according to claim 1, wherein the before-ejecting distance acquisition unit acquires the before-ejecting distance by using transport-direction and perpendicular-direction lengths of the predetermined mark and a perpendicular-direction length of the predetermined mark at a detection position of the predetermined mark in the transport direction.

5. The fluid ejecting apparatus according to claim 1, wherein the target is configured so that the set ejection area is disposed in a predetermined interval in the transport direction, wherein, when the predetermined mark is detected by the mark detection unit, the before-ejecting distance acquisition unit acquires a predetermined number of the before-ejecting distances from the predetermined mark to a predetermined number of two or more of the set ejection areas in the rear side in the transport direction, and wherein the control unit performs control based on the before-ejecting distance of a predetermined number.

6. A method of controlling a fluid ejecting apparatus which includes a transport unit transporting a target, a fluid ejection unit moving in a perpendicular direction perpendicular to a transport direction of the target and being capable of ejecting the fluid from a nozzle to the target, and a mark detection unit moving in the perpendicular direction together with the fluid ejection unit and being capable of detecting a predetermined mark formed in the target to eject the fluid in a set ejection area of the target, the method comprising:

(a) acquiring a before-ejecting distance, which is a distance from a detection position of the predetermined mark in the transport direction to the set ejection area, based on a perpendicular-direction length of the predetermined mark when the predetermined mark having a shape where the perpendicular-direction length is increased or decreased in the transport direction is detected by the mark detection unit during the movement of the fluid ejection unit; and (b) controlling the transport unit and the fluid ejection unit based on the acquired before-ejecting distance so that the target is transported by the transport unit and the fluid is ejected from the nozzle to the set ejection area while the fluid ejection unit moves in the perpendicular direction.

7. A program for embodying the steps of the method of controlling a fluid ejecting apparatus according to claim 6 on one computer or a plurality of computers.

8. A target used for a fluid ejecting apparatus including a transport unit transporting the target, a fluid ejection unit moving in a perpendicular direction perpendicular to a transport direction of the target and being capable of ejecting the fluid from a nozzle to the target, a mark detection unit moving in the perpendicular direction together with the fluid ejection unit and being capable of detecting a predetermined mark formed in the target, a before-ejecting distance acquisition unit acquiring a before-ejecting distance, which is a distance from a detection position of the predetermined mark in the transport direction to the set ejection area, based on a perpendicular-direction length of the predetermined mark when the predetermined mark is detected by the mark detection unit during the movement of the fluid ejection unit, and a control unit controlling the transport unit and the fluid ejection unit based on the acquired before-ejecting distance so that the target is transported by the transport unit and the fluid is ejected from the nozzle to the set ejection area while the fluid ejection unit moves in the perpendicular direction, wherein the predetermined mark has a shape where the perpendicular-direction length is increased or decreased in the transport direction.

9. The target according to claim 8, wherein the predetermined mark is any one of a triangle having a side in the perpendicular direction and a trapezoid having two sides in the perpendicular direction.

10. The target according to claim 8, wherein the predetermined mark is a hole.

* * * * *